US005272777A

United States Patent [19]

Favagrossa

[11] Patent Number: 5,272,777

[45] Date of Patent: Dec. 28, 1993

[54] BED TRANSFORMABLE INTO ARMCHAIR

[75] Inventor: Francesco Favagrossa, Ghedi, Italy

[73] Assignee: Fiam Style S.r.l., Brescia, Italy

[21] Appl. No.: 942,593

[22] Filed: Sep. 9, 1992

[30] Foreign Application Priority Data

Sep. 11, 1991 [IT] Italy ..... BS/91/U/000078

[51] Int. Cl.[5] ..... A47C 17/00

[52] U.S. Cl. ..... 5/110; 5/45; 297/22; 297/377

[58] Field of Search ..... 5/111, 110, 112, 45, 5/114, 633, 634; 297/22, 31, 16, 377, 379

[56] References Cited

U.S. PATENT DOCUMENTS

| | | | |
|---|---|---|---|
| 239,583 | 3/1881 | White | 297/22 |
| 795,174 | 7/1905 | Shackelford | 297/22 |
| 1,361,042 | 12/1920 | Fuller | 5/634 |
| 2,200,912 | 5/1940 | Brandon | 297/22 |
| 2,279,852 | 4/1942 | Webster . | |
| 2,678,085 | 5/1954 | DeMinno | 5/634 X |
| 3,107,940 | 10/1963 | Brooks . | |
| 4,292,698 | 10/1981 | Acker | 5/45 |
| 4,635,998 | 1/1987 | Hickey | 297/31 |
| 4,639,953 | 2/1987 | McElmurry et al. | 5/45 X |

FOREIGN PATENT DOCUMENTS

| | | | |
|---|---|---|---|
| 136977 | 4/1985 | European Pat. Off. | 5/633 |
| 56386 | 9/1952 | France . | |
| 2587185 | 9/1985 | France . | |
| 514934 | 11/1939 | United Kingdom . | |
| WO88/01841 | 3/1988 | World Int. Prop. O. . | |

*Primary Examiner*—Peter M. Cuomo
*Assistant Examiner*—Michael J. Milano
*Attorney, Agent, or Firm*—McGlew and Tuttle

[57] ABSTRACT

A piece of furniture which can be transformable between a bed and a chair. A bed frame 1 is connected to a back 2 by an arm 4. The arm 4 is pivotably connected at one end to the bed frame and pivotably connected at another end to the back. A hook 6 is connected to the back 2 and this hook 6 engages with either a bed pivot 7 or a chair pivot 10 in order to form the piece of furniture into either a bed or a chair. A bar 8 is connected to the back 2 and this bar 8 either engages with notches 9 in the bed frame or with notches 11 in the arm 4.

5 Claims, 2 Drawing Sheets

BED TRANSFORMABLE INTO ARMCHAIR

FIELD OF THE INVENTION

The object of this invention is a camping—as well as garden and/or beach—bed which can be used with a back to sit down as in an armchair.

BACKGROUND OF THE INVENTION

A type of bed is already known in which the portion where the bust rests is free to slide along the frame-forming pipes and can be fixed to them by two opposite supporting catches as to form an armchair.

Such a solution has the disadvantage that it doesn't allow a variation of the inclination of the back either when the device is used as a bed or when it is used as an armchair.

SUMMARY AND OBJECTS OF THE INVENTION

The object of this invention is to eliminate the above mentioned disadvantages through a new and different combination of the parts so to make a variation of the inclination possible independent of the position of the bed.

Thus, this invention proposes a transformable bed in which the portion where the bust rests, i.e. a back, is pivoted to the frame through a pair of levers which can be translated and overturned together with the said portion toward the forward part of the frame when an armchair is to be prepared.

Further details will be more evident in the following description referring to the enclosed drawings in which:

DETAILED DESCRIPTION OF THE PREFERRED EMBODIMENT

Figure 1:
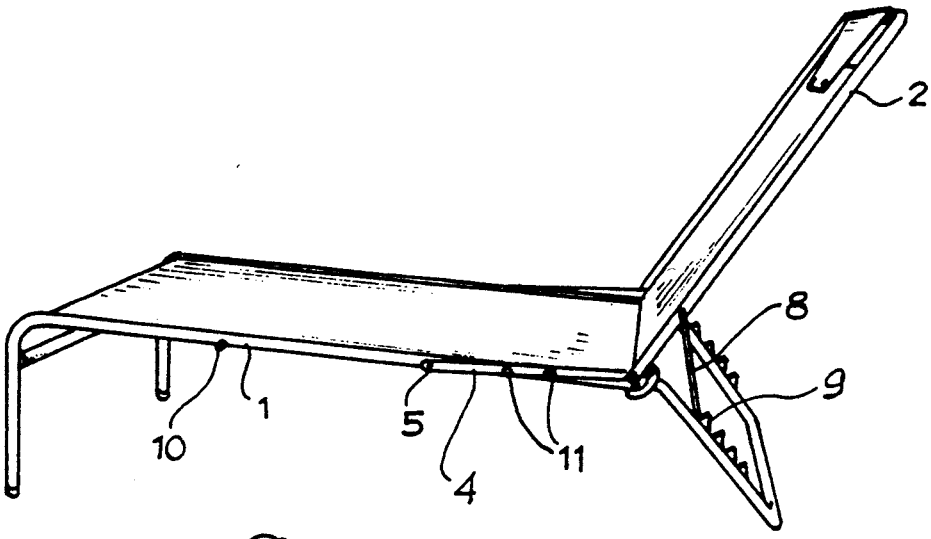
FIG. 1 shows a global view of the bed.

In the drawing, the bed frame is indicated by reference 1 while the portion where the bust rests is indicated by 2. This portion 2 is pivoted at 3 to a pair of arms 4 which are pivoted at 5 to the opposite sides of the bed frame 1.

A pair of hooks 6 is constrained to the pipes forming the frame of 2 and it is free to rotate independently from arms 4. The hooks are devices which bind the back 2 to the bed frame 1 through bed pivot means 7 fitted on the sides of the frame.

An indication adjustment means includes a U-shaped bar 8 pivoted to the pipes of the back 2 and designed to lean on overhangs 9 projecting from the pair of the bed legs, so as to permit changing the inclination of the back 2 as wished.

Figure 4:
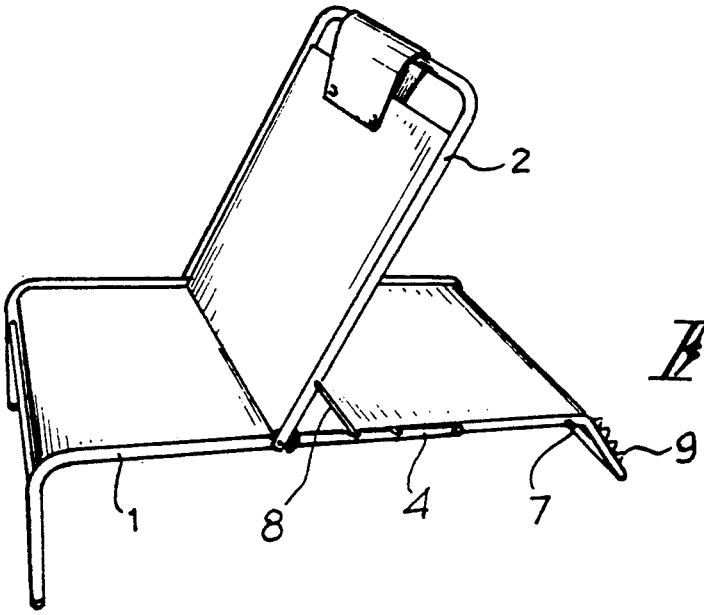
FIG. 4 shows the bed in the form of an armchair.
Figure 3:
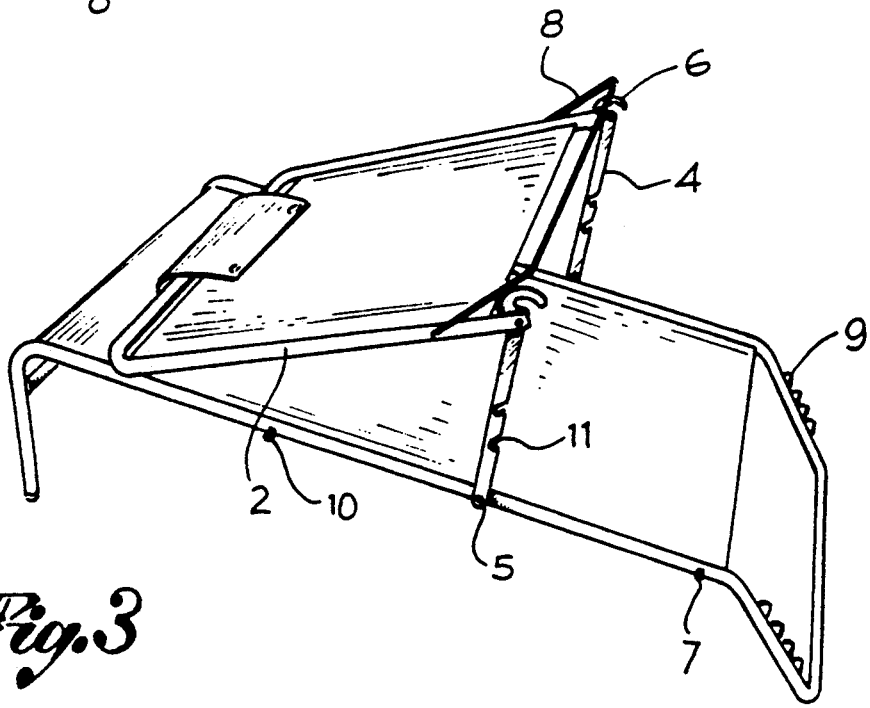
FIG. 3 shows the bed with the back during the overturning to form an armchair.
Figure 2:
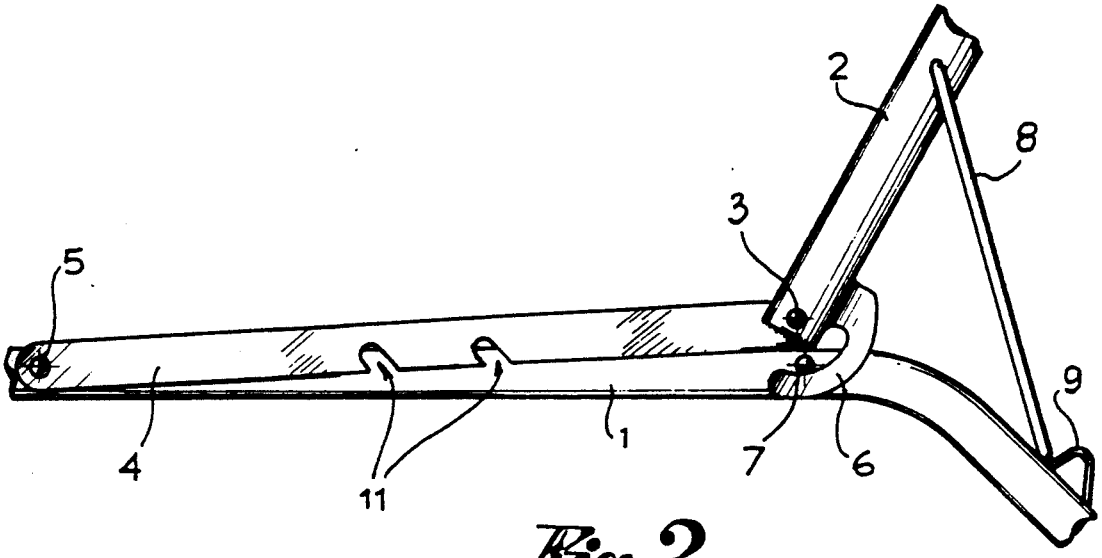
FIG. 2 shows the detail of the device which constrains the back to the bed frame.
Figure 5:
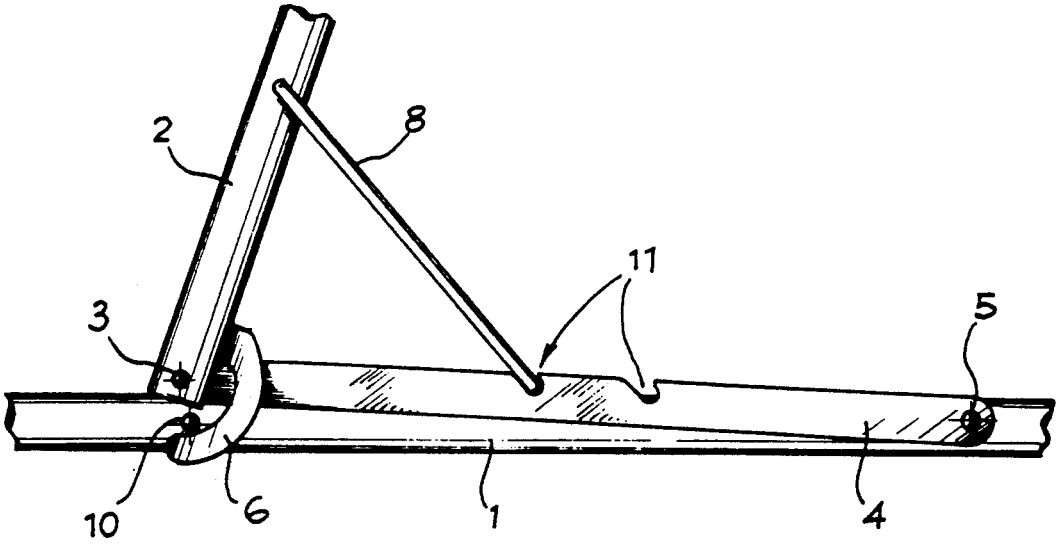
FIG. 5 shows the constraint device of FIG. 2 when the bed is set as an armchair.

When the portion 2 is inclined forwards, the pair of hooks 6 unhooks from the bed pivot means 7 so that the arms 4 and the back 2 (see FIG. 3) can be moved forwards. Then the pair of hooks 6, together with the back 2, can be fixed to chair pivot means 10 installed in the middle of frame 1, so as to form an armchair (see FIG. 4).

On the arms 4 there are notches 11 for setting and blocking the U-shaped bar 8 so that the inclination of the back 2 can be varied also when the bed is set and used as an armchair.

What is claimed is:

1. A bed transformable into an armchair, comprising:
   - a back including a hook positioned on one side of said back;
   - an arm having an end pivotably connected to said one side of said back;
   - a bed frame pivotably connected to another end of said arm, said bed frame including bed pivot means for engaging with said hook of said back, said bed frame defining overhangs;
   - inclination adjustment means for adjusting an inclination of said back, said inclination adjustment means including a bar connected to said back and engaging with said overhangs of said bed frame.

2. A bed in accordance with claim 1, wherein:
   - said back includes another hook positioned spaced from said hook and another arm is pivotably connected to another side of said back;
   - said bed frame includes another bed pivot means spaced from said bed pivot means and for engaging with said another hook when said bed pivot means is engaged with said hook;
   - said bar of said inclination adjustment means has a substantially u-shape;
   - said bed pivot means and said another bed pivot means are fixed integral with said bed frame.

3. A bed in accordance with claim 1, wherein:
   - said bed frame includes chain pivot means spaced from said bed pivot means and for engaging with said hook of said back to form a chair.

4. A bed in accordance with claim 1, wherein:
   - said arm defines a plurality of notches and said bar of said inclination adjustment means also engages with said notches of said arm.

5. A bed in accordance with claim 1, wherein:
   - said arm is connected to said bed frame at a connection point, and said bed pivot means is positioned on an opposite side of said connection point from said chair pivot means.

* * * * *